US009456676B2

(12) United States Patent
Suzuki

(10) Patent No.: US 9,456,676 B2
(45) Date of Patent: Oct. 4, 2016

(54) COSMETIC CONTAINER

(71) Applicant: TOKIWA CORPORATION, Nakatsuawa-shi, Gifu (JP)

(72) Inventor: Takumi Suzuki, Kawaguchi (JP)

(73) Assignee: TOKIWA CORPORATION, Nakatsugawa-shi (JP)

( * ) Notice: Subject to any disclaimer, the term of this patent is extended or adjusted under 35 U.S.C. 154(b) by 0 days.

(21) Appl. No.: 14/802,113

(22) Filed: Jul. 17, 2015

(65) Prior Publication Data

US 2016/0022005 A1 Jan. 28, 2016

(30) Foreign Application Priority Data

Jul. 23, 2014 (JP) ..... 2014-150007

(51) Int. Cl.

| | |
|---|---|
| ***A46B 11/00*** | (2006.01) |
| ***A45D 33/00*** | (2006.01) |
| ***A45D 40/26*** | (2006.01) |
| ***A45D 33/36*** | (2006.01) |
| ***A45D 40/10*** | (2006.01) |
| *A45D 34/04* | (2006.01) |

(52) U.S. Cl.

CPC ..... *A45D 33/006* (2013.01); *A45D 33/36* (2013.01); *A45D 40/10* (2013.01); *A45D 40/261* (2013.01); *A45D 40/264* (2013.01); *A45D 40/265* (2013.01); *A45D 34/045* (2013.01)

(58) Field of Classification Search

CPC ..... A45D 33/006; A45D 40/264; A45D 40/265; A45D 34/045

USPC ..... 401/126, 127

See application file for complete search history.

(56) References Cited

U.S. PATENT DOCUMENTS

| | | | | |
|---|---|---|---|---|
| 6,164,857 | A * | 12/2000 | Wolfarth-Brooks | A45D 34/045 401/126 |
| 6,773,186 | B1 * | 8/2004 | Shih | A45D 33/34 401/127 |
| 7,228,864 | B2 * | 6/2007 | Tahara | A45D 33/006 132/313 |
| 8,944,712 | B2 * | 2/2015 | Thorpe | A45D 34/045 132/218 |
| 8,967,895 | B2 * | 3/2015 | Svendsen | A45D 34/045 132/218 |
| 2012/0114409 | A1 * | 5/2012 | Chiang | A45D 33/00 401/126 |

FOREIGN PATENT DOCUMENTS

| | | |
|---|---|---|
| JP | 2002-125750 A | 5/2002 |

* cited by examiner

*Primary Examiner* — Jennifer C Chiang

(74) *Attorney, Agent, or Firm* — Westerman, Hattori, Daniels & Adrian, LLP

(57) ABSTRACT

A cosmetic container is configured such that when a cover is rotated against a container main body in the removing direction, a guided part of a stopper portion rotated in sync with a grip portion is first guided by a guiding part of a joint, the stopper portion, the sleeve portion, and a cosmetic material M or an application body 3 move to the side of the container main body, the cosmetic material and the application body contact each other, and the screwing operation of the first and second screw parts then takes effect, to cause the cover to be removed from the container main body. This enables an appropriate amount of the cosmetic material to be attached to the application body along with a removing operation of the cover from the container main body without the need for a particular operation.

6 Claims, 5 Drawing Sheets

COSMETIC CONTAINER

TECHNICAL FIELD

The present invention relates to a cosmetic container.

BACKGROUND ART

Conventionally, there is known a cosmetic container including a container main body housing inside a solid cosmetic material or a cosmetic material made by solidifying a powdered cosmetic material, a cover removably mounted on this container main body, and an application body such as a puff, wherein the application body is housed between the cosmetic material and the cover in a compressed state when the cover is mounted on the container main body (when the cover is closed), and a user can pick up with his/her fingers and take out the application body for use in application when the cover is removed from the container main body (when the cover is opened) (e.g., refer to Japanese Unexamined Patent Publication No. 2002-125750 (Patent Literature 1)).

CITATION LIST

Patent Literature

Patent Literature 1: Japanese Unexamined Patent Application Publication No. 2002-125750

However, the above cosmetic container has problems in which the cosmetic material excessively attaches to the application body, and in which the application body is compressed and squashed, at the time of storage, at which the cover is mounted on the container main body.

An object of the present invention is to provide a cosmetic container enabling an appropriate amount of cosmetic material to be attached to an application body along with a removing operation of a cover from a container main body and enabling squash of the application body to be prevented along with a mounting operation of the cover on the container main body without the need for a particular operation.

Solution to Problem

A cosmetic container according to the present invention includes a container main body formed in a cylindrical shape with one end closed, provided on a cylindrical wall thereof with a first screw part, and including a first one of a cosmetic material or an application body, and a cover formed in a cylindrical shape with one end closed, provided on a cylindrical wall thereof with a second screw part which can be screwed with the first screw part, and including a second one of the cosmetic material or the application body. The first and second screw parts screw together to cause the cover to be removably mounted on the container main body. The cover includes a joint provided with the second screw part and provided with a guiding part adapted to guide the second one of the cosmetic material or the application body, a grip portion disabled to move in an axial direction against the joint, enabled to be rotated around an axis against the joint, and rotated by a user, a sleeve portion integrated with the second one of the cosmetic material or the application body, enabled to move in the axial direction against the grip portion, and enabled to be rotated in sync with the grip portion, and a stopper portion enabled to be rotated in sync with the sleeve portion, provided with a guided part guided by the guiding part due to rotation of the grip portion, and moving in the axial direction. When the cover is mounted on the container main body, the stopper portion, the sleeve portion, and the second one of the cosmetic material or the application body are retracted to a backward limit, and the cosmetic material and the application body are away from each other. At time of a rotating operation of the cover against the container main body in a removing direction, the guided part of the stopper portion is guided by the guiding part of the joint, the stopper portion, the sleeve portion, and the second one of the cosmetic material or the application body move to a side of the container main body, and the cosmetic material and the application body contact each other, and when the rotating operation is continued in the same direction, the grip portion and the joint are integrated, and a screwing operation of the first and second screw parts takes effect, to cause the cover to be removed from the container main body. At time of a rotating operation of the cover against the container main body in a mounting direction, the screwing operation of the first and second screw parts takes effect, to cause the cover to be mounted on the container main body, and when the screwing operation of the first and second screw parts stops, the grip portion and the joint are rotatable, the guided part of the stopper portion is guided by the guiding part of the joint, the stopper portion, the sleeve portion, and the second one of the cosmetic material or the application body are retracted to the backward limit, and the cosmetic material and the application body are separated from each other.

According to the above cosmetic container, when the cover is mounted on the container main body, the cosmetic material and the application body are away from each other. When the cover is rotated against the container main body in the removing direction, the guided part of the stopper portion rotated in sync with the grip portion is first guided by the guiding part of the joint, the stopper portion, the sleeve portion, and the cosmetic material or the application body move to the side of the container main body, the cosmetic material and the application body contact each other, and the screwing operation of the first and second screw parts then takes effect, to cause the cover to be removed from the container main body. This enables an appropriate amount of the cosmetic material to be attached to the application body along with a removing operation of the cover from the container main body without the need for a particular operation. Also, when the cover is rotated against the container main body in the mounting direction, the screwing operation of the first and second screw parts first takes effect, to cause the cover to be mounted on the container main body, the guided part of the stopper portion rotated in sync with the grip portion is then guided by the guiding part of the joint, the stopper portion, the sleeve portion, and the cosmetic material or the application body move in a reverse direction of the above direction, and the cosmetic material and the application body are separated from each other. This enables squash of the application body to be prevented along with a mounting operation of the cover on the container main body without the need for a particular operation.

In a case in which the cover includes an elastic body urging the sleeve portion to the side of the container main body, the sleeve portion can move in the axial direction smoothly by the urging force of the elastic body.

In this case, the elastic body is preferably a coil spring.

Also, in a case in which a forward limit of the sleeve portion is set further to the side of the container main body than a position at which the cosmetic material and the application body contact, even when the amount of the cosmetic material decreases along with use, the second one of the cosmetic material or the application body follows the degree of the decrease to contact the first one of the cosmetic material or the application body. Accordingly, an appropriate amount of the cosmetic material can be attached to the application body at all times in accordance with the degree of the decrease of the cosmetic material. Also, in a case in which the second one of the cosmetic material or the application body is the application body, in which the application body and the sleeve portion are integrated, and in which the elastic body is provided, when the cover is removed from the container main body, the sleeve portion, which is prevented from moving further to the side of the container main body due to the contact between the cosmetic material and the application body, is further pushed forward by the urging force of the elastic body to the forward limit, which is an optimal position for use of the application body. Accordingly, the user can start makeup immediately, and application with use of the application body is further facilitated.

Advantageous Effects of Invention

According to the present invention, it is possible to attach an appropriate amount of cosmetic material to an application body along with a removing operation of a cover from a container main body and to prevent squash of the application body along with a mounting operation of the cover on the container main body without the need for a particular operation.

DESCRIPTION OF EMBODIMENT

Hereinbelow, embodiments of the present invention will be described in detail with reference to the attached drawings.

Figure 1:
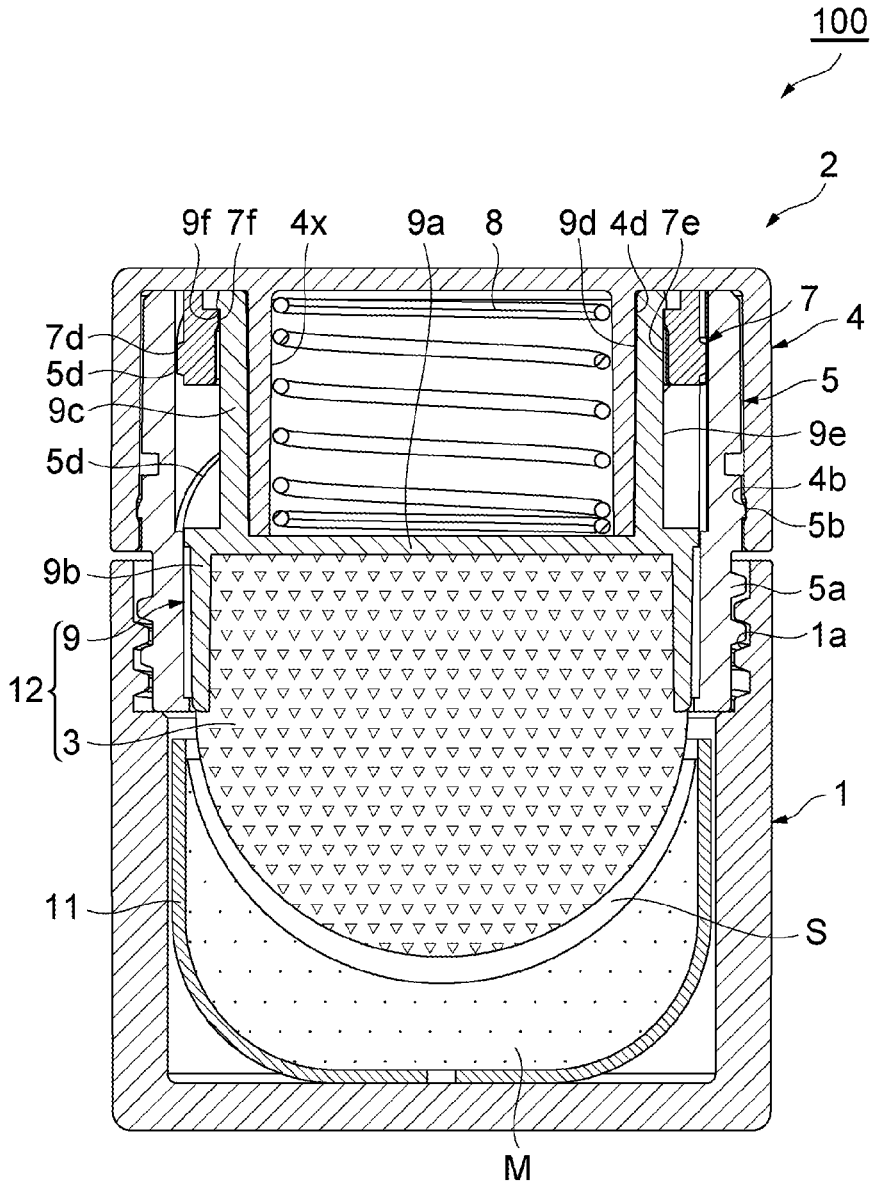
FIG. 1 is a vertical cross-sectional view illustrating a cosmetic container according to an embodiment of the present invention.
Figure 2:
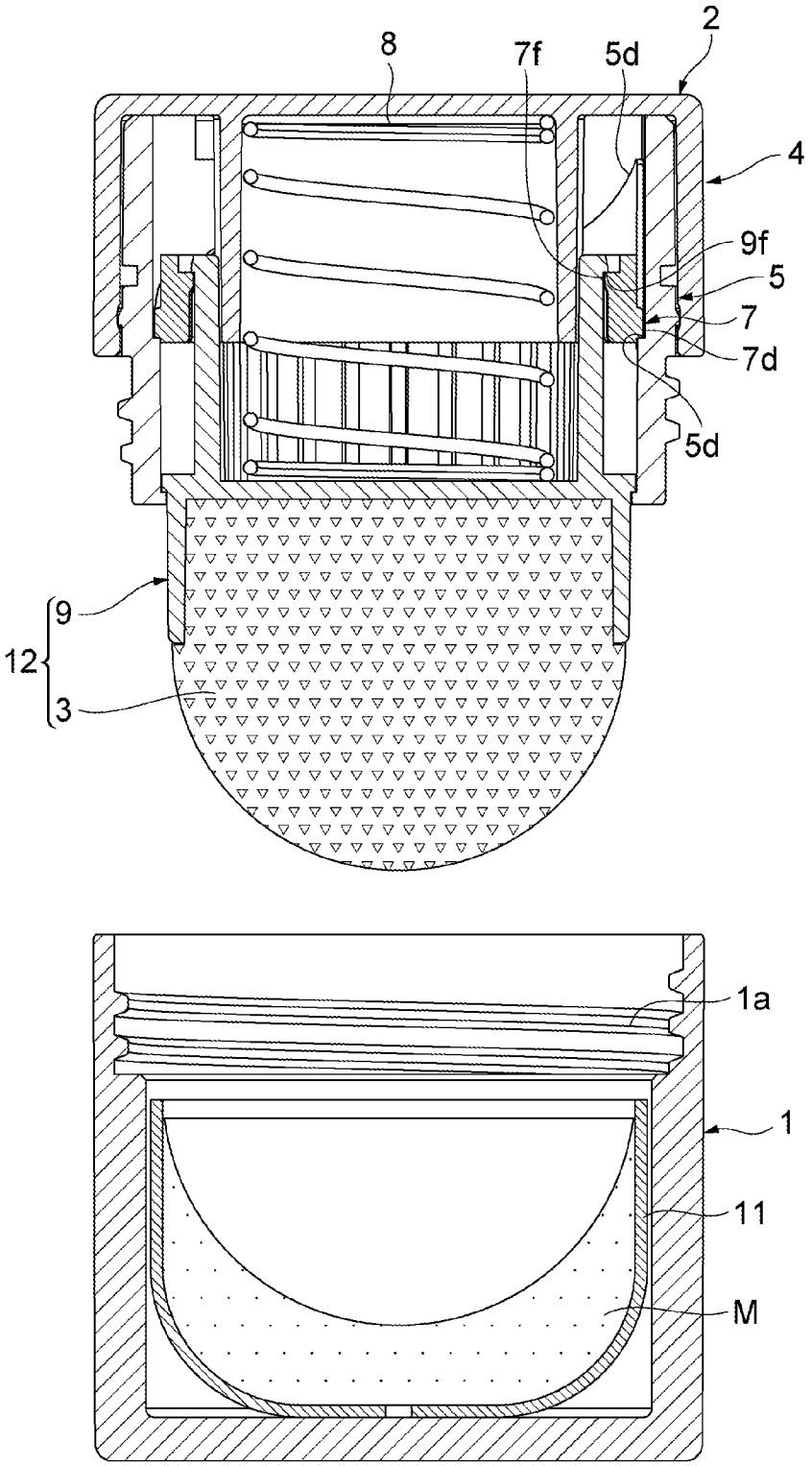
FIG. 2 is a vertical cross-sectional view illustrating a state in which a cover has been removed subsequent to a state in FIG. 1.
Figure 3:
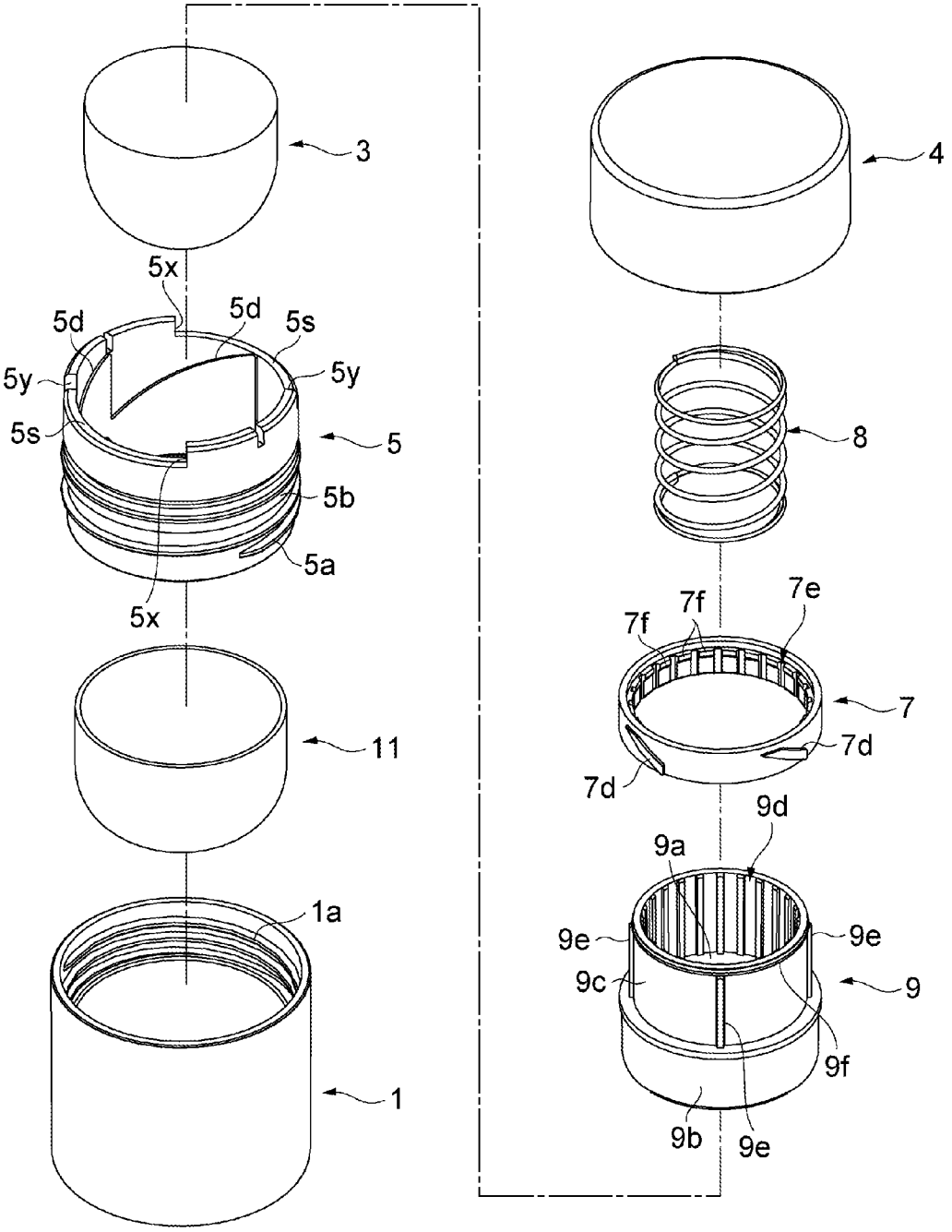
FIG. 3 is an exploded perspective view of the cosmetic container illustrated in FIG. 1 as seen from an upper side.
Figure 4:
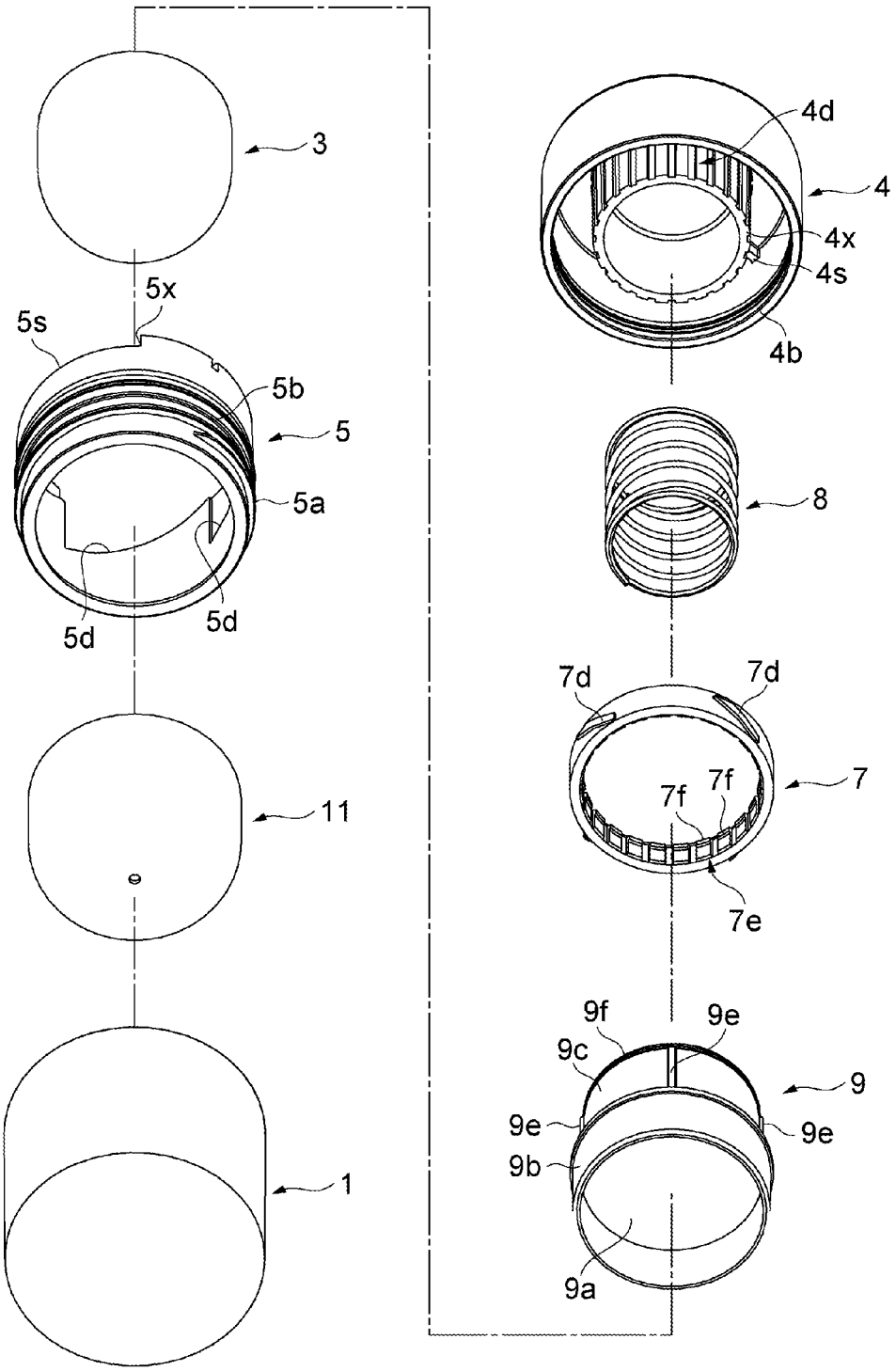
FIG. 4 is an exploded perspective view of the cosmetic container illustrated in FIG. 1 as seen from a lower side.

FIG. 1 is a vertical cross-sectional view illustrating a cosmetic container according to an embodiment of the present invention, FIG. 2 is a vertical cross-sectional view illustrating a state in which a cover has been removed, and FIGS. 3 and 4 are exploded perspective views of the cosmetic container.

As illustrated in FIG. 1, a cosmetic container 100 according to the present embodiment is used when a user applies a cosmetic material M to his/her face or the like. Containers 1 and 2 house the cosmetic material M and an application body 3 therein. The cosmetic material M attaches to the application body 3 when a cover is opened, while the application body 3 and the cosmetic material M are in a non-contact state when the cover is closed. The cosmetic container 100 will be described in detail below. It is to be noted that upper and lower sides are based on the drawings.

The cosmetic material M is herein pressed powder as being particularly preferable. However, the cosmetic material M may be a cosmetic material made by solidifying a powdered cosmetic material, a creamy cosmetic material, or the like. A state of the cosmetic material is not limited as long as the cosmetic material is applicable to the present invention.

The cosmetic container 100 includes a container main body 1 housing the cosmetic material M and a cover 2 covering this container main body 1 from an upper side to be removably mounted on the container main body 1.

The container main body 1 is formed in a cylindrical shape with one end closed (a bottomed cylindrical shape) and has in a lower half part inside a cylinder wall thereof a housing space for housing the cosmetic material M as illustrated in FIGS. 1, 3, and 4. This housing space is provided with a cosmetic material housing portion 11 housing the cosmetic material M on an upper surface thereof. The cosmetic material housing portion 11 is formed in a cup shape with an upper side opened, and the cosmetic material M is housed in a mortar shape, curved with a center downward, to conform to the cup shape. On the cylinder wall on an upper portion of the container main body 1, a screw part (a first screw part) 1*a* for mounting the cover 2 is provided along a circumferential direction to extend in an axial direction. The screw part 1*a* is herein a female screw formed on an inner circumferential surface.

The cover 2 includes the application body 3 for applying the cosmetic material M and includes a grip portion 4 functioning as a cover and gripped by the user for a rotating operation, a joint 5 engaged with the grip portion 4 and removably engaged with the container main body 1, a stopper portion 7 moving in the axial direction of the cover 2 in response to rotation of the grip portion 4, a sleeve portion 9 mounting the application body 3 thereon and moving in the axial direction together with the stopper portion 7, and an elastic body 8 urging an application tool 12 including the application body 3 and the sleeve portion 9 to a side of the container main body 1.

The grip portion 4 is formed in a short cylindrical shape with one end closed (a bottomed cylindrical shape) and is arranged to be opposed to the container main body 1. On an inner circumferential surface of a cylindrical wall of this grip portion 4, a recess 4*b* adapted to be engaged with the joint 5 in the axial direction is provided annularly. Also, a cylindrical projecting part 4*x* projecting toward the side of the container main body 1 is formed at a bottom of the grip portion 4, and on an outer circumferential surface of a cylindrical wall of this projecting part 4*x*, a knurl 4*d* extending in the axial direction and provided with protrusions and recesses arranged in parallel in the circumferential direction is provided to be engaged with the sleeve portion 9 in a rotating direction. An inside of the projecting part 4*x* is a housing space for the elastic body 8. Also, on an inside surface on an outer rim side of the bottom of the grip portion 4, a pair of projections 4*s* which will abut on first and second ends 5*x* and 5*y* of cut-out parts 5*s* of the joint 5 at the time of rotation of the grip portion 4 is provided to be opposed to each other. It is to be noted that, since the grip portion 4 is gripped by the user for the rotating operation, the grip portion 4 is preferably provided on an outer circumferential surface thereof with a knurl or the like provided with protrusions and recesses arranged in parallel in the circumferential direction to prevent slipping.

The joint 5 is formed in a cylindrical shape and is provided on a cylindrical wall thereof on the side of the container main body 1 with a screw part (a second screw part) 5*a* which can be screwed with the screw part 1*a* of the container main body 1 along the circumferential direction. The screw part 5*a* is herein a male screw formed on an outer circumferential surface. On the outer circumferential surface of the joint 5 further on a side of the grip portion 4 than the screw part 5*a*, an annular protrusion 5*b* is provided to be engaged with the recess 4*b* of the grip portion 4 in the axial direction. On an inner circumferential surface of the joint 5 further on the side of the grip portion 4 than the screw part 5*a*, four slopes inclined to draw spirals in the axial direction are continuously provided along the circumferential direction as guiding parts 5*d* adapted to guide the stopper portion 7. Specifically, each of the slopes as the guiding parts 5*d* is inclined downward from an upper end along the circumferential direction, heads for a lower end while drawing an arc, and is raised vertically to an upper end after reaching the lower end. The procedure is repeated in the circumferential direction.

Also, on an upper end surface of the joint 5, the cut-out parts 5*s* formed in an arc in a planar view cut out toward a lower side are provided at paired positions opposed to each other along the circumferential direction. Each of the projections 4*s* of the grip portion 4 goes into each of these cut-out parts 5*s*, and from the time the projection 4*s* of the grip portion 4 abuts on the first end 5*x* of the cut-put part 5*s* due to rotation of the grip portion 4, integral rotation of the grip portion 4 and the joint 5 in one direction is enabled. When the projection 4*s* of the grip portion 4 abuts on the second end 5*y* of the cut-put part 5*s* due to reverse rotation of the grip portion 4, the application body 3 reaches a backward limit.

In the sleeve portion 9 constituting the application tool 12, a lower cylindrical part 9*b* is erected on a lower surface of a circular plate part 9*a* while an upper cylindrical part 9*c* is erected on an upper surface thereof. The lower cylindrical part 9*b* has a slightly larger diameter than the upper cylindrical part 9*c*.

On an inner circumferential surface of the upper cylindrical part 9*c*, a knurl 9*d* extending in the axial direction and provided with protrusions and recesses arranged in parallel in the circumferential direction is provided to be engaged with the knurl 4*d* of the projecting part 4*x* of the grip portion 4 in the rotating direction. Also, at an upper end of the upper cylindrical part 9*c*, a flange 9*f* preventing the stopper portion 7 from coming off upward is provided annularly. On an outer circumferential surface of the upper cylindrical part 9*c* further on a lower side than the flange 9*f*, linear protrusions 9*e* adapted to be engaged with the stopper portion 7 in the rotating direction are provided at four positions equally spaced in the circumferential direction to extend in the axial direction.

The application body 3 constituting the application tool 12 has an outer surface thereof stretched outward and formed approximately in a hemispherical shape and is an elastic body such as a sponge and a puff, made of a porous material such as urethane foam and NBR, provided on one surface thereof with hair.

The application body 3 has an upper end part thereof fitted into the lower cylindrical part 9*b* of the sleeve portion 9 to be held in close contact with the lower cylindrical part 9*b*.

The stopper portion 7 is formed in a short cylindrical shape and includes on an outer circumferential surface thereof guided parts 7*d* guided by the guiding parts 5*d* of the joint 5. The guided parts 7*d* are arranged at four positions equally spaced in the circumferential direction to be away from each other so as to correspond to the guiding parts 5*d* of the joint 5. Each of the guided parts 7*d* rides on each of the guiding parts 5*d* of the joint 5 and is an inclined projection slidable on the guiding part 5*d* as an inclined slope.

On an inner circumferential surface of the stopper portion 7, a knurl 7*e* extending in the axial direction and provided with protrusions and recesses arranged in parallel in the circumferential direction is provided to be engaged with the linear protrusions 9*e* of the upper cylindrical part 9*c* of the sleeve portion 9 in the rotating direction. At an upper part of each protrusion constituting this knurl 7*e*, a protrusion 7*f* abutting on the flange 9*f* of the sleeve portion 9 to prevent the stopper portion 7 from coming off upward is provided to project inward and extend in an arc.

The elastic body 8 is herein a compression coil spring and is housed into the projecting part 4*x* of the grip portion 4.

In a state in which the grip portion 4 is arranged upside down, the elastic body 8 is housed into the projecting part 4*x* of the grip portion 4. In this state, the sleeve portion 9 holding the application body 3 and provided with the stopper portion 7 to enable the sleeve portion 9 to be rotated in sync with the stopper portion 7 is mounted to enable the sleeve portion 9 to be rotated in sync with the grip portion 4 and to enable the sleeve portion 9 to move in the axial direction against the grip portion 4 so that the knurls 4*d* and 9*d* may mesh with each other. The joint 5 is then inserted into the cylindrical wall of the grip portion 4 and mounted over the stopper portion 7 and lets the protrusion 5*b* thereof engaged with the recess 4*b* of the grip portion 4 in the axial direction to be mounted to disable the joint 5 to move in the axial direction against the grip portion 4 and to enable the joint 5 to be rotated around the axis against the grip portion 4.

At this time, the sleeve portion 9 is urged to the side of the container main body 1 by the elastic body 8. The flange 9*f* of the sleeve portion 9 abuts on the protrusions 7*f* of the stopper portion 7, and the guided parts 7*d* of the stopper portion 7 abut on the guiding parts 5*d* of the joint 5, to bring a state in which the stopper portion 7 is interposed between the flange 9*f* of the sleeve portion 9 and the guiding parts 5*d* of the joint 5 and a state in which the guided parts 7*d* of the stopper portion 7 are slidable on the guiding parts 5*d* of the joint 5. In this state, the elastic body 8 is in a state of accumulating a urging force between the bottom of the grip portion 4 and the circular plate part 9*a* of the sleeve portion 9.

Next, operations of the cosmetic container 100 configured as above will be described. First, as illustrated in FIG. 1, in a case in which the cover 2 is mounted on the container main body 1, the cosmetic material M and the application body 3 are away from each other in a state in which the application body 3, the sleeve portion 9, and the stopper portion 7 are retracted to the backward limit (retracting limit), a space S is provided between the cosmetic material M and the application body 3, and the cosmetic material M and the application body 3 are in the non-contact state.

In a case in which the user uses the cosmetic container 100 in this state, the user holds the container main body 1 and the cover 2 and rotates the cover 2 in a removing direction (a loosening direction or a screwing releasing direction) to remove the cover 2. Since the screw part 5*a* of the joint 5 of the cover 2 is tightened to a screw limit against the screw part 1*a* of the container main body 1, the container main body 1 and the joint 5 are integrated, the grip portion 4 is rotated against the joint 5, the sleeve portion 9 and the stopper portion 7 are rotated together with the grip portion 4, and the guided parts 7*d* of the stopper portion 7 move to the side of the container main body 1 while being guided by the guiding parts 5*d* of the joint 5 and being rotated.

At this time, since the sleeve portion 9 is urged to the side of the container main body 1 by the urging force of the elastic body 8, the stopper portion 7, the sleeve portion 9, and the application body 3 move smoothly. Thereafter, the application body 3 contacts the cosmetic material M and is prevented from moving further.

In this manner, when the application body 3 contacts the cosmetic material M and is prevented from moving further forward, the projections 4*s* of the grip portion 4 abut on the first ends 5*x* of the cut-out parts 5*s*, the grip portion 4 and the joint 5 are integrated (enabled to be rotated synchronously in an equal direction), and as a result of a subsequent further rotating operation in the removing direction, a screwing operation of the screw part 1*a* of the container main body 1 and the screw part 5*a* of the joint 5 takes effect, to cause the cover 2 to be removed from the container main body 1.

The application body 3, the stopper portion 7, and the sleeve portion 9, which are prevented from moving further to the side of the container main body 1 due to the contact between the cosmetic material M and the application body 3, are then pushed forward by the urging force of the elastic body 8 to a forward limit (pushing limit), which is an optimal position for use (refer to FIG. 2).

In use, when the user holds the cover 2 and softly taps the application body 3 on the user's face or the like, an appropriate amount of the cosmetic material M attached to the application body 3 is applied to his/her face or the like.

When the user finishes the use, the user holds the container main body 1 and the cover 2 and rotates the cover 2 in a mounting direction (a tightening direction or a screwing direction) to mount the cover 2. The screw part 5*a* of the joint 5 of the cover 2 is then screwed into the screw part 1*a* of the container main body 1 and is tightened to the screw limit, and the screwing operation of the screw part 1*a* of the container main body 1 and the screw part 5*a* of the joint 5 thus stops. The cover 2 is mounted on the container main body 1, and the container main body 1 and the joint 5 are integrated. As a result of a subsequent further rotating operation in the mounting direction, the grip portion 4 is rotated against the joint 5, the sleeve portion 9 and the stopper portion 7 are rotated together with the grip portion 4, the guided parts 7*d* of the stopper portion 7 move to the bottom side of the grip portion 4, which is a reverse direction of the above direction, while being guided by the guiding parts 5*d* of the joint 5 and being rotated, and the application body 3, the sleeve portion 9, and the stopper portion 7 are retracted to the backward limit, in which the projections 4*s* of the grip portion 4 abut on the second ends 5*y* of the cut-out parts 5*s*. Thus, the cosmetic material M and the application body 3 are in a state of being away from each other (refer to FIG. 1).

In this manner, in the present embodiment, when the cover 2 is mounted on the container main body 1, the cosmetic material M and the application body 3 are away from each other. When the cover 2 is rotated against the container main body 1 in the removing direction, the guided parts 7*d* of the stopper portion 7 rotated in sync with the grip portion 4 are first guided by the guiding parts 5*d* of the joint 5, the stopper portion 7, the sleeve portion 9, and the application body 3 move to the side of the container main body 1, the cosmetic material M and the application body 3 contact each other, and the screwing operation of the first and second screw parts 1*a* and 5*a* then takes effect, to cause the cover 2 to be removed from the container main body 1. This enables an appropriate amount of the cosmetic material M to be attached to the application body 3 along with a removing operation of the cover 2 from the container main body 1 without the need for a particular operation. Also, when the cover 2 is rotated against the container main body 1 in the mounting direction, the screwing operation of the first and second screw parts 1*a* and 5*a* first takes effect, to cause the cover 2 to be mounted on the container main body 1, the guided parts 7*d* of the stopper portion 7 rotated in sync with the grip portion 4 are then guided by the guiding parts 5*d* of the joint 5, the stopper portion 7, the sleeve portion 9, and the application body 3 move in the reverse direction of the above direction, and the cosmetic material M and the application body 3 are separated from each other. This enables squash of the application body 3 to be prevented along with a mounting operation of the cover 2 on the container main body 1 without the need for a particular operation.

Also, since the cover 2 includes the elastic body 8, which urges the sleeve portion 9 to the side of the container main body 1, the sleeve portion 9 can move in the axial direction smoothly by the urging force of the elastic body 8.

Also, the forward limit of the sleeve portion 9 is set further to the side of the container main body 1 than a position at which the cosmetic material M and the application body 3 contact. Accordingly, even when the amount of the cosmetic material decreases along with use, the application body 3 follows the degree of the decrease to contact the cosmetic material M on the side of the container main body 1, and an appropriate amount of the cosmetic material M can be attached to the application body 3 at all times in accordance with the degree of the decrease of the cosmetic material M.

Also, when the cover 2 is removed from the container main body 1, the sleeve portion 9, which is prevented from moving further to the side of the container main body 1 due to the contact between the cosmetic material M and the application body 3, is further pushed forward by the urging force of the elastic body 8 to the forward limit, which is the optimal position for use of the application body 3. Accordingly, the user can start makeup immediately, and application with use of the application body 3 is further facilitated.

Meanwhile, in a case in which the stopper portion 7 is eliminated from the above cosmetic container 100, the cosmetic container 100 can be a cosmetic container having a configuration in which the application body 3 contacts the cosmetic material M due to the elastic body 8 when the cover 2 is mounted on the container main body 1.

Although the present invention has been described above specifically based on the embodiment, the present invention is not limited to the above embodiment. For example, although the elastic body 8 is a coil spring as being particularly preferable in the above embodiment, the elastic body 8 may be one made by laminating a plurality of plate springs, a plastic spring, or the like.

Also, as for the combination of the male screw and the female screw constituting the screw parts and the combination of the guiding part 5*d* and the guided part 7*d*, the components may be switchable in the above embodiment.

Also, although the sleeve portion 9 and the stopper portion 7 are separated products in the above embodiment, an integrated product or one into which separate products are combined and integrated may also be available.

Figure 5:
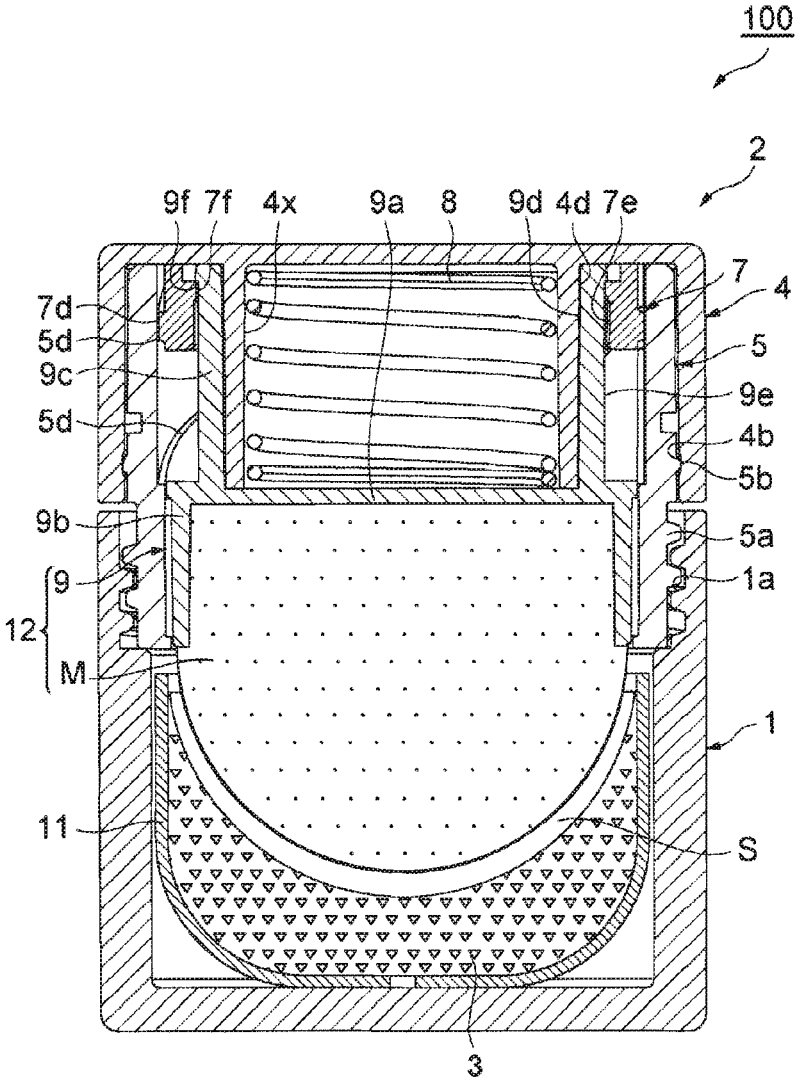
FIG. 5 is a vertal cross-sectional view, illustrating a cosmetic container according to another embodiment of the present invention.

Also, although the container main body 1 includes the cosmetic material M while the cover 2 includes the application body 3 in the above embodiment, the container main body 1 may include the application body 3, and the cover 2 may include the cosmetic material M as shown in FIG. 5 and may be configured to include the aforementioned grip portion 4, joint 5, sleeve portion 9, stopper portion 7, and the like, to cause the cosmetic material M to move and approach to and separate from the application body 3.

What is claimed is:

1. A cosmetic container comprising:

a container main body formed in a cylindrical shape with one end closed, provided on a cylindrical wall thereof with a first screw part, and including a first one of a cosmetic material or an application body; and a cover formed in a cylindrical shape with one end closed, provided on a cylindrical wall thereof with a second screw part which can be screwed with the first screw part, and including a second one of the cosmetic material or the application body, wherein the first and second screw parts screw together to cause the cover to be removably mounted on the container main body, and wherein the cover includes:

a joint provided with the second screw part and provided with a guiding part adapted to guide the second one of the cosmetic material or the application body;

a grip portion disabled to move in an axial direction against the joint, enabled to be rotated around an axis against the joint, and rotated by a user;

a sleeve portion integrated with the second one of the cosmetic material or the application body, enabled to move in the axial direction against the grip portion, and enabled to be rotated in sync with the grip portion; and a stopper portion enabled to be rotated in sync with the sleeve portion, provided with a guided part guided by the guiding part due to rotation of the grip portion, and moving in the axial direction, wherein, when the cover is mounted on the container main body, the stopper portion, the sleeve portion, and the second one of the cosmetic material or the application body are retracted to a backward limit, and the cosmetic material and the application body are away from each other, wherein, at time of a rotating operation of the cover against the container main body in a removing direction, the guided part of the stopper portion is guided by the guiding part of the joint, the stopper portion, the sleeve portion, and the second one of the cosmetic material or the application body move to a side of the container main body, and the cosmetic material and the application body contact each other, and when the rotating operation is continued in the same direction, the grip portion and the joint are integrated, and a screwing operation of the first and second screw parts takes effect, to cause the cover to be removed from the container main body, and wherein, at time of a rotating operation of the cover against the container main body in a mounting direction, the screwing operation of the first and second screw parts takes effect, to cause the cover to be mounted on the container main body, and when the screwing operation of the first and second screw parts stops, the grip portion and the joint are rotatable, the guided part of the stopper portion is guided by the guiding part of the joint, the stopper portion, the sleeve portion, and the second one of the cosmetic material or the application body are retracted to the backward limit, and the cosmetic material and the application body are separated from each other.

2. The cosmetic container according to claim 1, wherein the cover includes an elastic body urging the sleeve portion to the side of the container main body.

3. The cosmetic container according to claim 2, wherein the elastic body is a coil spring.

4. The cosmetic container according to claim 1, wherein a forward limit of the sleeve portion is set further to the side of the container main body than a position at which the cosmetic material and the application body contact.

5. The cosmetic container according to claim 2, wherein a forward limit of the sleeve portion is set further to the side of the container main body than a position at which the cosmetic material and the application body contact.

6. The cosmetic container according to claim 3, wherein a forward limit of the sleeve portion is set further to the side of the container main body than a position at which the cosmetic material and the application body contact.

* * * * *